US006289522B1

(12) United States Patent
Jones et al.

(10) Patent No.: US 6,289,522 B1
(45) Date of Patent: Sep. 18, 2001

(54) WRESTLING HEADGEAR

(76) Inventors: Deanna M. Jones, 2748 Bon Haven La., Annapolis, MD (US) 21401; Michael Nagro, 1290 Hardy Rd., Arnold, MD (US) 21012

( * ) Notice: Subject to any disclaimer, the term of this patent is extended or adjusted under 35 U.S.C. 154(b) by 0 days.

(21) Appl. No.: 09/642,809

(22) Filed: Aug. 22, 2000

(51) Int. Cl.[7] ..... A63B 71/10
(52) U.S. Cl. ..... 2/425; 2/DIG. 3; 2/423
(58) Field of Search ..... 2/425, 421, 423, 2/209, DIG. 3, DIG. 10

(56) References Cited

U.S. PATENT DOCUMENTS

| | | | | |
|---|---|---|---|---|
| 2,901,751 | * | 9/1959 | Gales et al. . | |
| 3,513,482 | * | 5/1970 | Holden . | |
| 3,588,914 | * | 6/1971 | Ihnat, Jr. . | |
| 3,761,959 | * | 10/1973 | Dunning . | |
| 4,060,855 | * | 12/1977 | Rappleyea . | |
| 4,566,137 | * | 1/1986 | Gooding | 2/425 |
| 4,700,410 | * | 10/1987 | Westgate | 2/209 |
| 4,847,921 | * | 7/1989 | Leutholt et al. | 2/425 |
| 4,856,116 | * | 8/1989 | Sullivan . | |
| 5,003,631 | * | 4/1991 | Richardson . | |
| 5,177,815 | * | 1/1993 | Andujar | 2/425 X |
| 5,504,945 | * | 4/1996 | Purnell | 2/425 |
| 5,685,021 | * | 11/1997 | Tsujino | 2/425 |
| 5,881,393 | | 3/1999 | Marchello | 2/425 |

OTHER PUBLICATIONS

Riddell (www.riddell.com)—Varsity Helmet (VSR–4); Varsity Helmet (WD–1); Varsity Helmet (AF–2); Junior Varsity Helmet; and Hardware Kits; Know Where It Goes On Your Helmet (6 pages).

Schutt Sports (www.schuttsports.com)—Schutt Pro AIR®II Helmet (Model 7788).

Schutt Sports (www.schuttsports.com)—Schutt AIR POWER® Helmet (Model 7700).

Schutt Sports (www.schuttsports.com)—Schutt AIR VARSITY® Helmet (Model 7896).

Schutt Sports (www.schuttsports.com)—Schutt AIR®IV™ Helmet (Model 7780).

Schutt Sports (www.schuttsports.com)—Schutt AIR®V™ Helmet (Model 7785).

Schutt Sports (www.schuttsports.com)—Schutt AIR®Youth™ Helmet (Model 7789).

Schutt Sports (www.schuttsports.com)—Schutt AIR®JR™ Helmet (Model 7898)

Schutt Sports (www.schuttsports.com)—Schutt AIR Pro™ 2800 Helmet.

Bike Athletic (www.bikeathletic.com)—THE BIKE EMS—Energy Management System (2 pp.).

Cascade (www.sporthelmets.com)—Lacrosse Helmets.

* cited by examiner

*Primary Examiner*—Rodney M. Lindsey
(74) *Attorney, Agent, or Firm*—Kenyon & Kenyon

(57) ABSTRACT

A wrestling headgear is disclosed. In an embodiment for a wrestling headgear ear protector of the present invention, the ear protector includes an ear protection member and a variably adjustable support member disposed on an inner portion of the ear protection member. In an embodiment for a method of the present invention, a method of defining an ear receiving cavity included in an ear protector of a wrestling headgear includes configuring a variably adjustable support member, the variably adjustable support member disposed on an inner portion of an ear protection member.

29 Claims, 11 Drawing Sheets

WRESTLING HEADGEAR

BACKGROUND OF THE INVENTION

1. Field of the Invention

The present invention relates to wrestling headgear, and more particularly to an ear protector for a wrestling headgear.

2. Description of the Related Art

Protective headgear for protecting an athlete's head, particularly for use during contact sports, is known. For example, helmets are utilized in football to protect the football player. Additionally, helmets are utilized to protect lacrosse players, hockey players, baseball players, etc. Even athletes that are not engaged in contact sports wear protective headgear, e.g., bicyclists. Because the helmet that is worn by a particular athlete must comfortably and adequately fit the head of the wearer in order to protect the athlete, it is known to provide padding in the helmet. The padding serves to add additional protection for the wearer but can also assist in providing for a comfortable fit for the wearer. As such, the padding engages with a relatively large surface area of the wearer's head. It is desirable for the padding to engage with a large surface area of the wearer's head in order to provide for adequate support and fit of the wearer's head within the helmet.

It is also known to be able to adjust the thickness of the padding within the helmet to provide for a more comfortable fit for a particular wearer. However, again, the padding still engages with a large surface area of the head and is formed and adjusted to provide for protection and fit of the entire head within the helmet. The adjustable padding merely enhances the fit of the wearer's entire head within the helmet.

Wrestling headgear is protective equipment used to cover, shield, and distribute impact forces away from the ears of wrestlers. Not only does the wrestling headgear protect the wrestler's ears from injury by isolating the ears from the impact forces, the headgear can also protect an injured ear of the wrestler from further injury. In order to protect a wrestler's ears from injury and to protect a wrestler's injured ear from further injury, each protective ear piece of the headgear isolates the ear from impact by defining a cavity within which a respective ear of the wrestler is positioned.

It is currently known to define the cavity of the ear piece by utilizing a material, such as foam rubber, in a ring configuration which is positioned on an inner portion of the ear piece and which thus surrounds the ear. However, drawbacks exist with the known apparatus. As mentioned above, a conventional way of protecting the ear in wrestling headgear is to add a layer of foam with the center cut out around the ear. The foam that is used has an adhesive backing so that it can be attached to the headgear ear piece. However, it is not possible to vary the dimensions of the cavity defined by the ear piece, and thus as defined by the foam rubber, without adding additional foam rubber to, or removing foam rubber from, the ear piece. This process can be unwieldy, time-consuming, and may not result in a desirable configuration for the cavity because of the difficulties that can be encountered when working with a material that is not variably configurable.

Other problems exist with conventional wrestling headgear. Conventional wrestling headgear includes two ear protectors with straps connecting the ear protectors. However, conventional wrestling headgear may slide away from the intended area of coverage due to the straps being inadequate for maintaining the positioning of the ear protectors over the ears. The potential for injury to a wrestler's ears due to this slippage is significant and can ultimately lead to permanent tissue damage.

Therefore, it is desirable to provide an improved method and apparatus for protecting an ear of a wrestler within a protective headgear.

SUMMARY OF THE INVENTION

A wrestling headgear is provided. In an embodiment for a wrestling headgear ear protector of the present invention, the ear protector includes an ear protection member and a variably adjustable support member disposed on an inner portion of the ear protection member.

In an embodiment for a method of the present invention, a method of defining an ear receiving cavity included in an ear protector of a wrestling headgear includes configuring a variably adjustable support member, the variably adjustable support member disposed on an inner portion of a protection member.

BRIEF DESCRIPTION OF THE DRAWINGS

The various features of the invention will best be appreciated by simultaneous reference to the description which follows and the accompanying drawings, in which.

DETAILED DESCRIPTION

Figure 1:
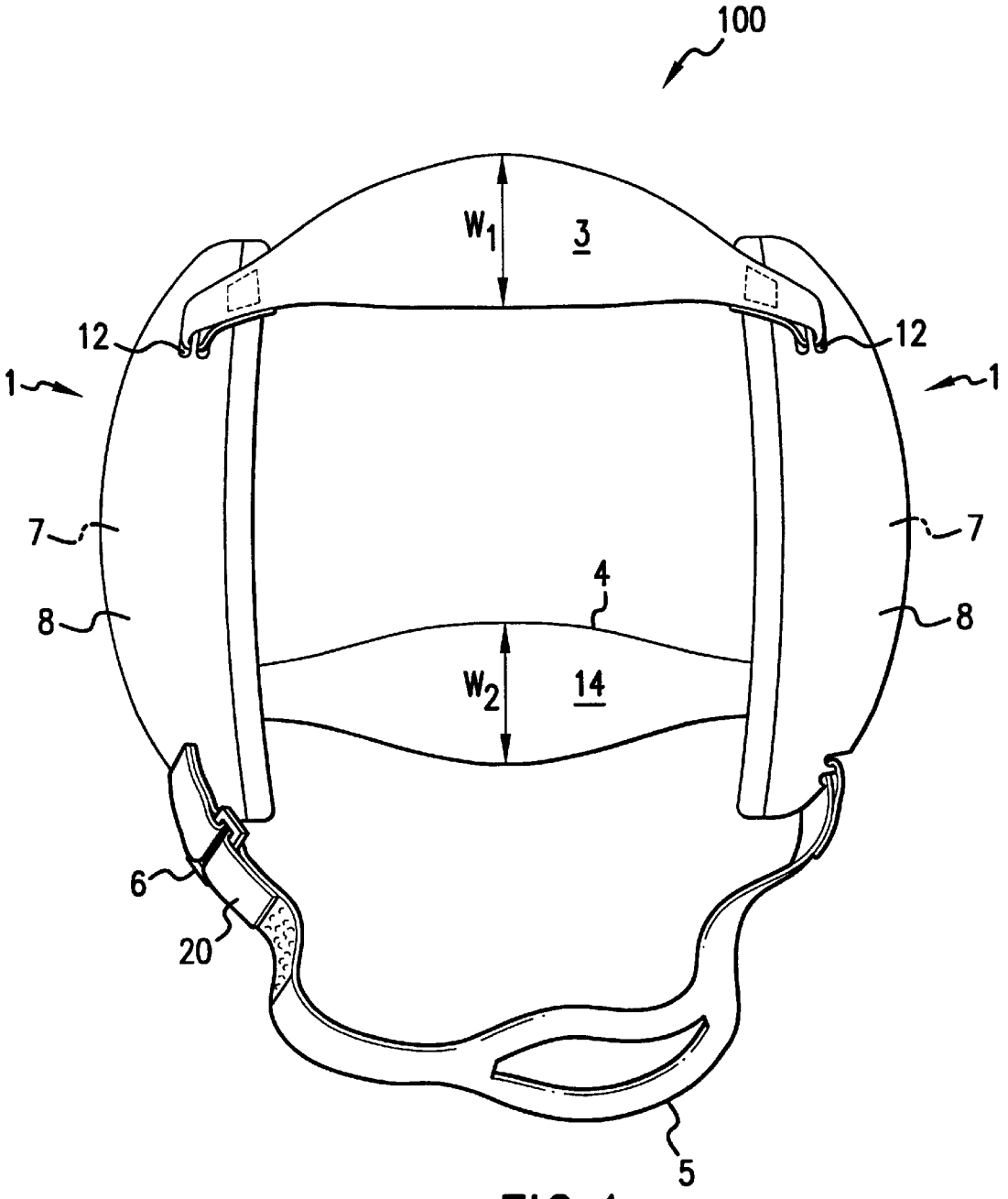
FIG. 1 is a front view of a wrestling headgear in accordance with the principles of the present invention.
Figure 2:
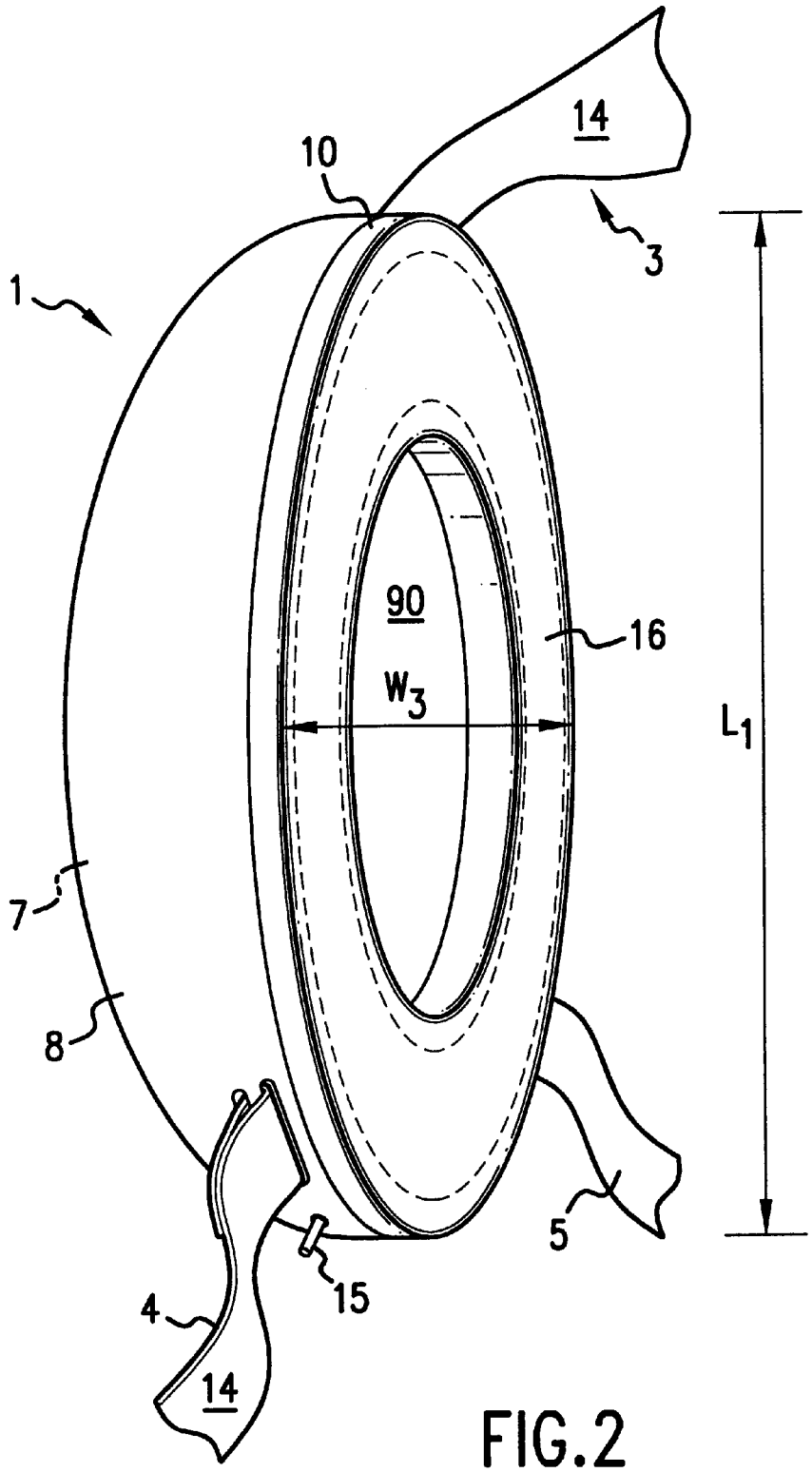
FIG. 2 is a perspective view of a wrestling headgear ear protector of the present invention.
Figure 9:
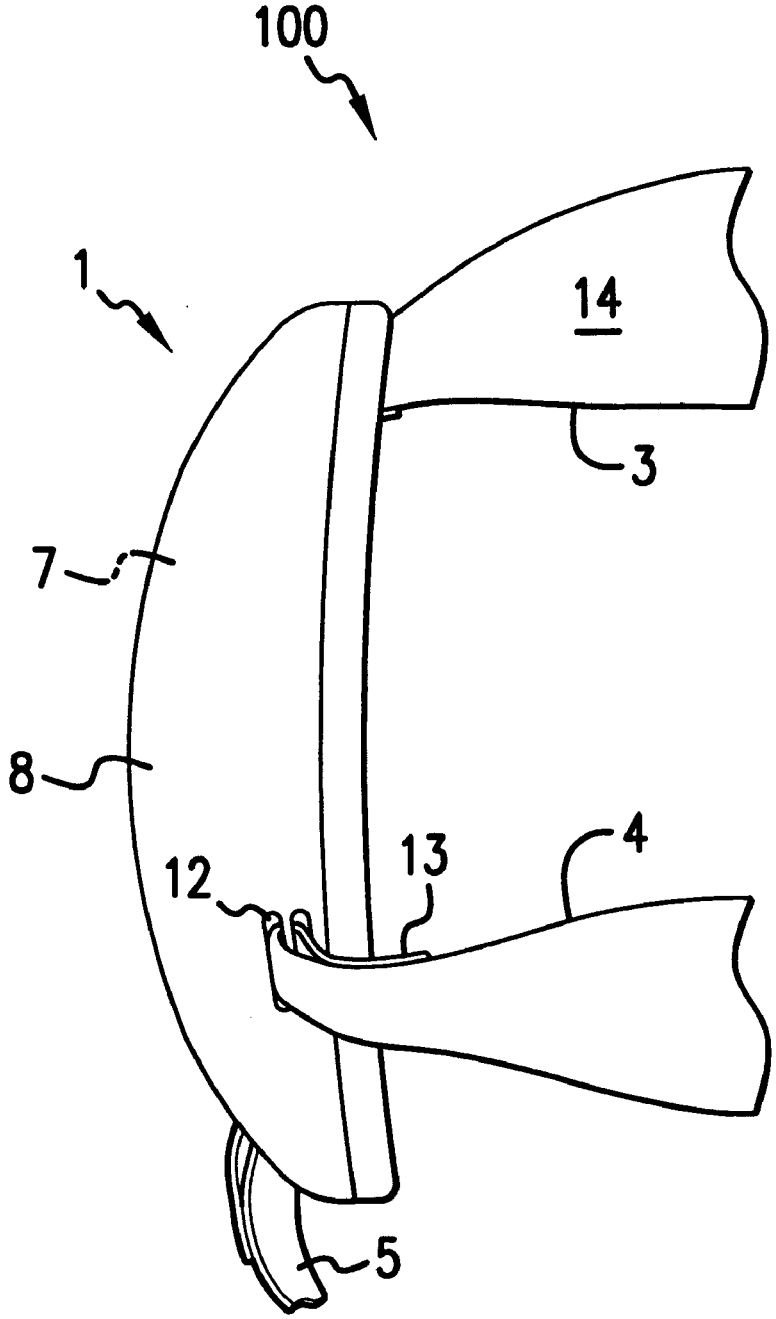
FIG. 9 is a partial rear view of the wrestling headgear of FIG. 1.

FIGS. 1 and 9 illustrate a first embodiment of a wrestling headgear in accordance with the principles of the present invention. As can be seen, wrestling headgear 100 includes two ear protectors 1. The two ear protectors can be disposed over the ears of a wrestler to isolate the ears from impact forces. The two ear protectors 1 can be connected using a first, or forehead, strap 3, a second, or chin, strap 5, and a third, or base head, strap 4. On the base head strap 4, a nonslip material 14 can be included on the inside of the strap, which is that portion of the strap that engages a wrestler's skin when the headgear 100 is put on the head of the wrestler. The non-slip material 14 prevents perspiration from causing the base head strap 4 to slip during a wrestling match. Non-slip material 14 can be any of a variety of materials that can perform the desired function, including natural leather chamois, synthetic chamois, textured synthetic low-slip polyester, or BIOSKIN™. By preventing slippage, ear protectors 1 remain in proper position with respect to the wrestler's head such that the wrestler's ears remain disposed within the protectors, thus, preventing injury to the wrestler's ears or preventing further injury to an injured ear(s) of the wrestler. Forehead strap 3 and chin strap 5 may also include a non-slip material on the inside of the straps, as described above.

Straps 3 and 4 can be of any width, however, it is desirable that they be of sufficient width to further assist in preventing slippage of the headgear on the wrestler's head. Representative widths for the straps are shown in FIG. 1 where the width $W_1$. of forehead strap 3 is approximately 2¼ inches and the width $W_2$ of base head strap 4 is approximately 2½ inches. Straps 3, 4, and 5 can be made of, for example, a nylon mesh material.

Figure 3:
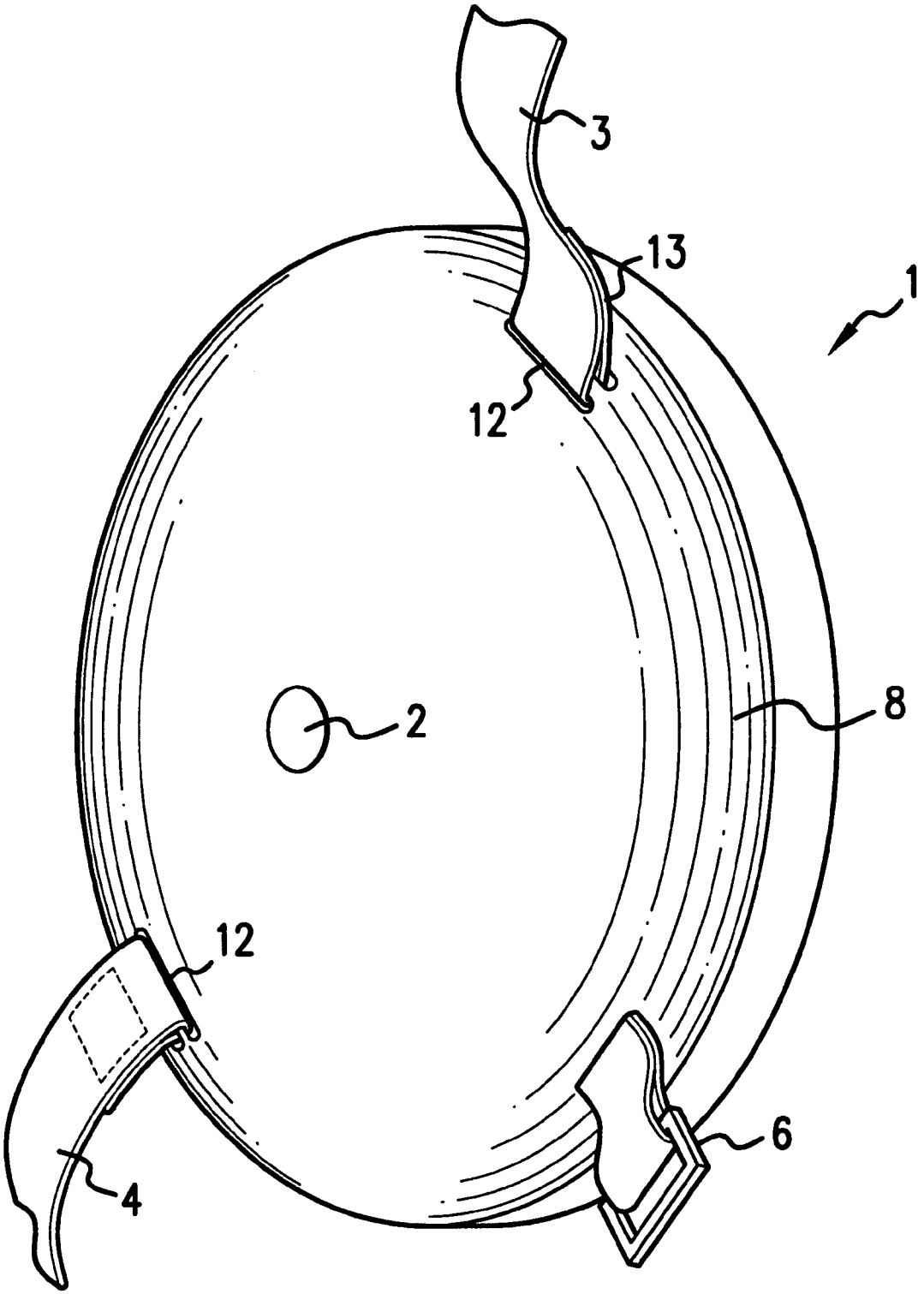
FIG. 3 is another perspective view of the ear protector of FIG. 2.

The forehead strap 3 can be fastened to each ear cover 1 through a hole 12 in each ear cover 1. The forehead strap 3 threads through the hole 12 in each ear cover 1 and fastens back upon itself by a fastener 13, as can be seen in FIG. 3. The fastener 13 can be any type of fastener, including a hook and loop fastener, such as VELCRO®. In addition, the base head strap 4 can also be attached to each ear cover 1 in the same manner.

However, unlike the forehead strap 3 and base head strap 4, the chin strap 5 is fastened to only one ear cover 1. A portion of chin strap 5 threads through a small opening near the jaw portion of the one ear cover 1 and doubles back over itself. It can be fastened by stitching. The second ear cover 1 has a loop 6 connected to a lower portion of the second ear cover 1. The loop 6 can be comprised of plastic or any other suitable material. To connect chin strap 5 to the second ear protector 1, chin strap 5 threads through loop 6 and fastens with a fastener 20 back upon itself as seen in FIG. 1. The fastener 20 can be comprised of, but is not limited to, a hook and loop fastener such as a VELCRO® fastener. When a wrestler places the headgear on his or her head, the fastener 20 of the chin strap 5 allows the wrestler to adjust the tightness of the chin strap 5 by changing the effective length of the chin strap between the two ear protectors 1, thus further helping to prevent injury by ensuring correct positioning of the wrestling headgear and by preventing unnecessary slippage of the wrestling headgear.

FIGS. 2–8 further illustrate one of the ear protectors 1 of the embodiment of FIG. 1. The ear protector 1 has a rounded shape on its outer periphery to provide for fitting around a wrestler's ear. A hole 2 is provided in the center of the ear protector 1 to allow the wrestler to hear and to provide for ventilation of the ear protector. The quantity of holes and location of holes can be modified according to design needs.

Figure 4:
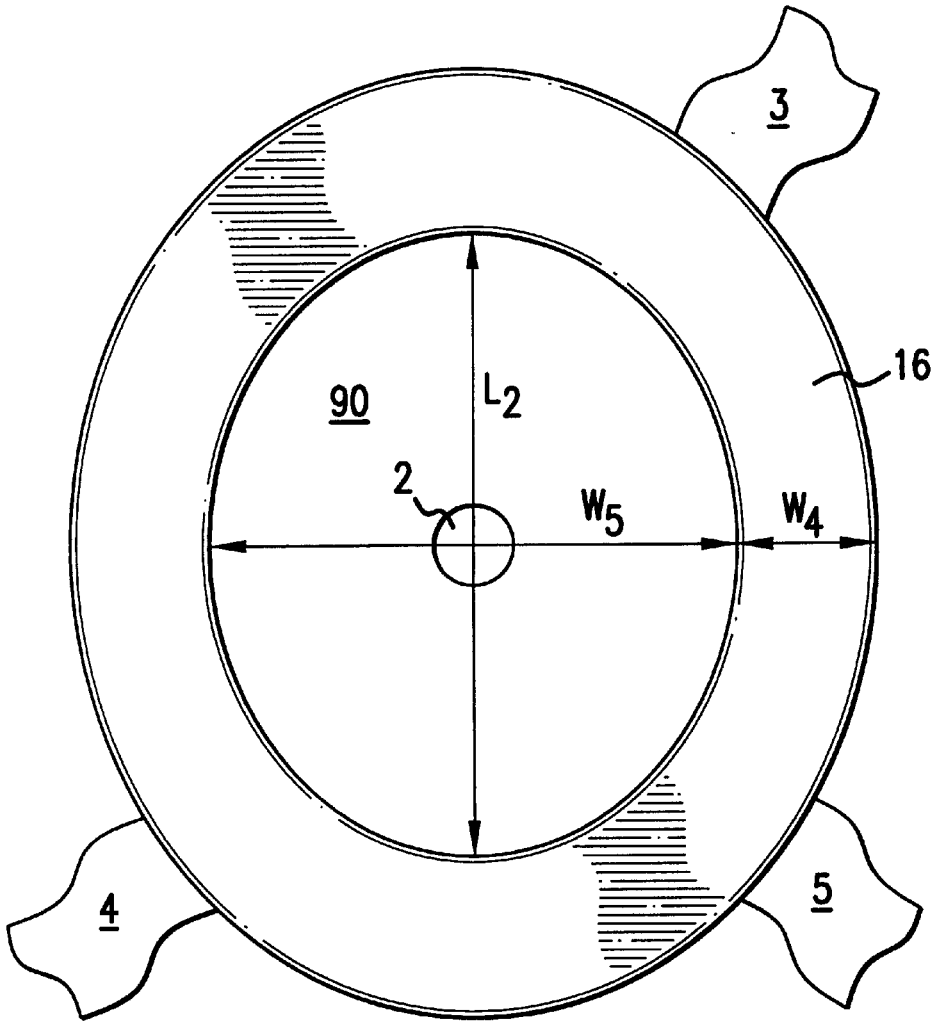
FIG. 4 is a view of the interior of the ear protector of FIG. 2.
Figure 5:
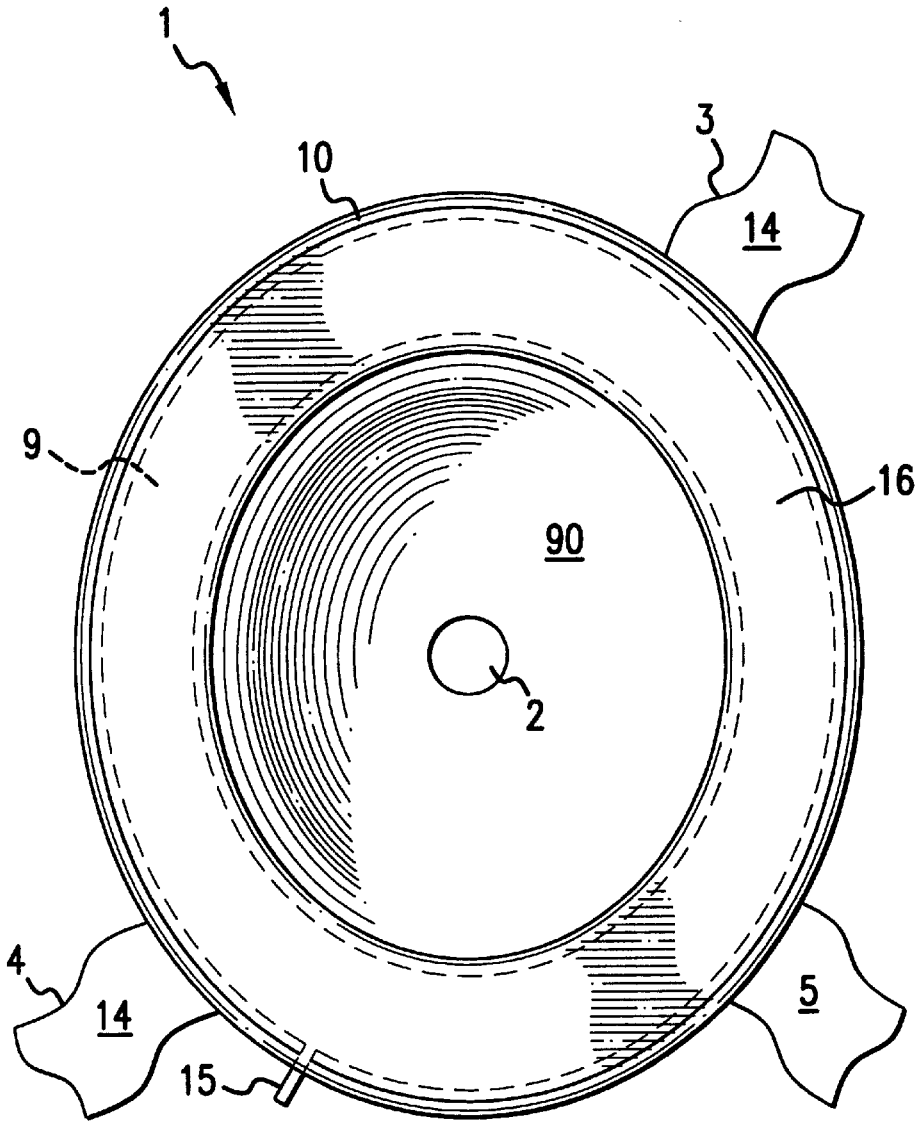
FIG. 5 is a second view of the interior of the ear protector of FIG. 2 with the variably adjustable support member shown in phantom.

The length $L_1$ and the width $W_3$ of the ear protector 1 can vary and the present invention is not limited to any particular dimensions. In the illustrative embodiment shown in FIGS. 2–8, the length $L_1$ of the ear protector 1 is approximately 5¾ inches and the width $W_3$ is about 4¾ inches. As can be seen in FIG. 4, a width $W_4$ of the internal portion of the ear protector 1 that engages with the wrestler's head and which surrounds the wrestler's ear is approximately 1¼ inches. As will be discussed later in this specification, and as can be seen in FIGS. 5–8, a variably adjustable support member 9 is included within this internal portion of the ear protector 1. The internal cavity 90 included in ear protector 1, as can also be seen in FIG. 4, has a representative length $L_2$ of approximately 3 inches and a representative width $W_5$ of approximately 2⅛ inches. As will also be discussed later in this specification, the depth of the internal cavity 90 included in ear protector 1 is variable and can be defined by configuring the variably adjustable support member 9.

FIGS. 5–8 further illustrate ear protector 1 of the present invention. As can be seen, ear protector 1 includes an ear protection member 11 and variably adjustable support member 9, as mentioned above, which is disposed on an inner portion of the ear protection member 11. Ear protection member 11 can be comprised of plastic or other materials, for example, composite materials or leather. The ear protection member 11 is covered by a first protective material 7 and a second protective material 8. The first protective material 7 is disposed on an outer portion of the ear protection member 11 and between the ear protection member 11 and the second protective material 8. The first protective material 7 can be comprised of different types of foams, including low, medium, or high-density, open or closed cell foam. In a preferred embodiment, the first protective material can be medium density, open or closed cell foam. The second protective material 8 can have a low coefficient of friction and can be, for example, nylon in an embodiment of the present invention. The second protective material 8 can also be spandex, polyester, synthetic rubber, and neoprene. Thus, the first protective material 7 is used in part to cushion the outer portion of the ear protection member 11 and the second protective material 8 is used to enable the ear protector 1 to slide easily along a wrestling mat.

Ear protector 1 may also include a third material 16. The variably adjustable support member 9 is disposed between the inner portion of the ear protection member 11 and the third material 16. The third material 16 can be, but is not limited to, chamois and can be a non-slip material. The chamois layer 16 can also act as a adding layer.

As discussed above, ear protector 1 includes a variably adjustable support member 9. In an embodiment of the present invention, the variably adjustable support member 9 is an expandable bladder. The expandable bladder may be a pneumatic ring that is expanded or contracted by using a gas, such as air, or may be a bladder that is expanded or contracted by using a liquid fill material, such as water. As such, the variably adjustable support member may be comprised of a gas inflatable bladder or a liquid inflatable bladder. Thus, the variably adjustable support member may be configured to various sizes by utilizing a variety of materials including air, water, gels, or any of a variety of other materials. A valve 15 may be used to both introduce materials into variably adjustable support member 9 and release materials from variably adjustable support member 9 for variably adjusting, and thus defining, the depth of the cavity 90 included in ear protection members 1, as will be further discussed later.

Figure 7:
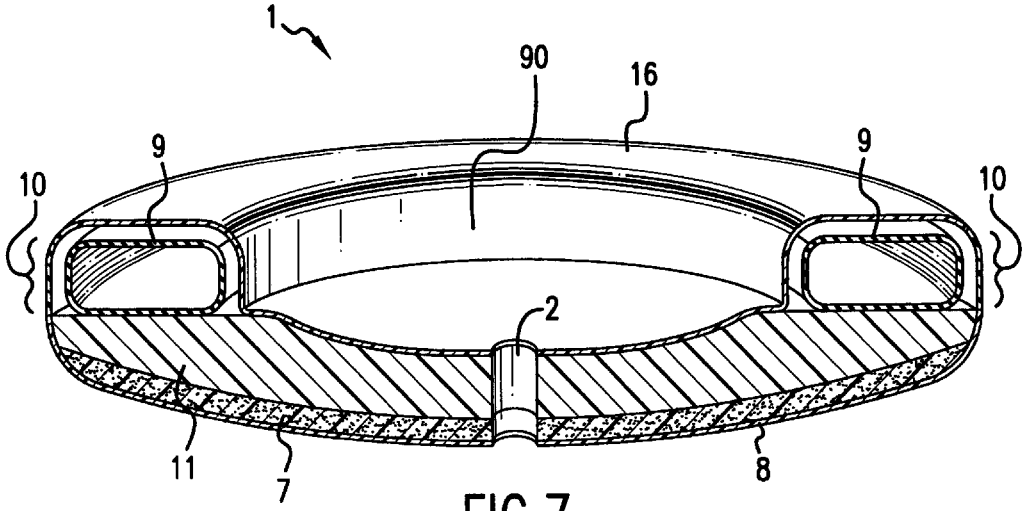
FIG. 7 is a partial cut-away view of the ear protector of the present invention.
Figure 8:
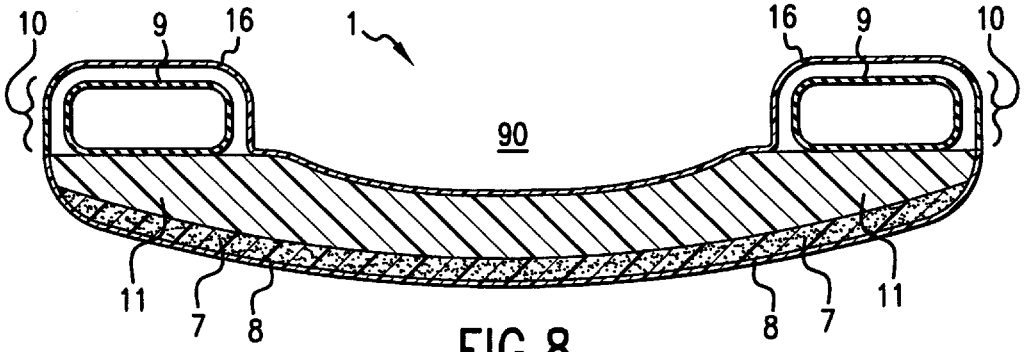
FIG. 8 is a cross-sectional view of the ear protector of the present invention as taken along line 8—8 of FIG. 6.

In an embodiment of the present invention, as illustrated in FIG. 7, in order to provide for the expansion and contraction of the variably adjustable support member 9, the second protective material 8 includes an adjustable portion 10 at an outer edge of the second protective material 8. The third material 16 is joined to the second protective material 8 at the adjustable portion 10. The adjustable portion 10 of the second protective material 8 is disposed at an outer edge of the ear protection member 11. Therefore, extending around the periphery of the outer edge of the variably adjustable support member 9 is adjustable portion 10. Adjustable portion 10 is expandable and contractible and may be comprised of materials such as nylon, elastic, or spandex.

As can be understood, adjustable portion 10 is configurable in a first expanded configuration when the variably adjustable support member 9 is configured in a first expanded configuration and adjustable portion 10 is configurable in a second contracted configuration when the variably adjustable support member 9 is configured in a second contracted configuration. Therefore, adjustable portion 10 surrounding the variably adjustable support member 9 of the ear protector 1 reconfigures as the support member 9 expands and contracts to define the depth of the ear cavity 90 included in ear protector 1.

As described above, and as can be understood, the depth of the ear cavity 90 that is included in each of ear protectors 1 can be defined by altering the size of the variably adjustable support member 9. To increase the depth of the cavity 90, the support member 9 is expanded, e.g., by inflating the member, which in-turn positions ear protection member 11 further from the wrestler's head due to the increased size of the structure, i.e., member 9, between the ear protection member and the wrestler's head. To decrease the depth of the cavity 90, the support member 9 is contracted, e.g., by deflating the member, which in-turn positions ear protection member 11 closer to the wrestler's head due to the decreased size of the structure between the ear protection member and the wrestler's head.

Figure 6:
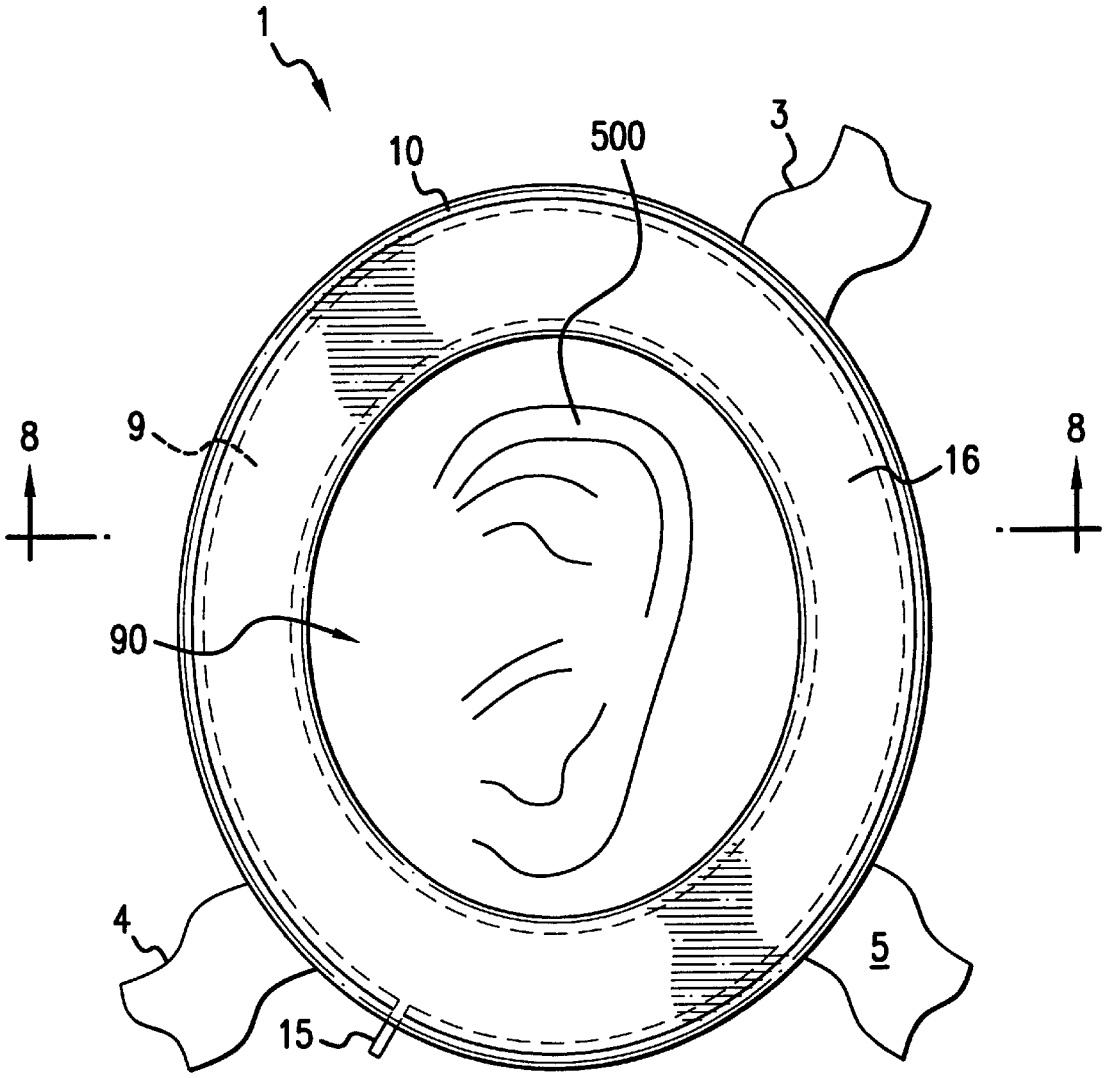
FIG. 6 is a view of the ear protector similar to FIG. 5 with an ear of a wrestler disposed within the cavity defined by the ear protector.

FIG. 6 illustrates ear protector 1 with a wrestler's ear 500 disposed within the cavity 90 included in the ear protector 1 and defined by the variably adjustable support member 9. Variably adjustable support member 9 is shown in phantom.

As discussed above, a method for defining the ear receiving cavity 90 of ear protector 1 includes the step of configuring the variably adjustable support member 9. The variably adjustable support member 9 is disposed on an inner portion of the ear protection member 11. As discussed previously, the variably adjustable support member 9 can be, for example, an air inflatable bladder, a water inflatable bladder, or a bladder fillable with any of a variety of other materials. Therefore, the step of configuring the variably adjustable support member may include changing the volume of fill material included within the variably adjustable support member 9.

In order to securely position the variably adjustable support member 9, a portion of the variably adjustable support member 9 is affixed with fastening means, which are not shown. These fastening means can be, for example, hook and loop fasteners like VELCRO®. Alternatively, the fastening means can be attached to the ear protection member 11 or to both the variably adjustable support member 9 and the ear protection member 11. The variably adjustable support member 9 is fastened to ear protection member 11 by the fastening means, which allows the variably adjustable support member 9 to be rotated to the exact configuration necessary to fit an individual wrestler's ear.

Figure 10:
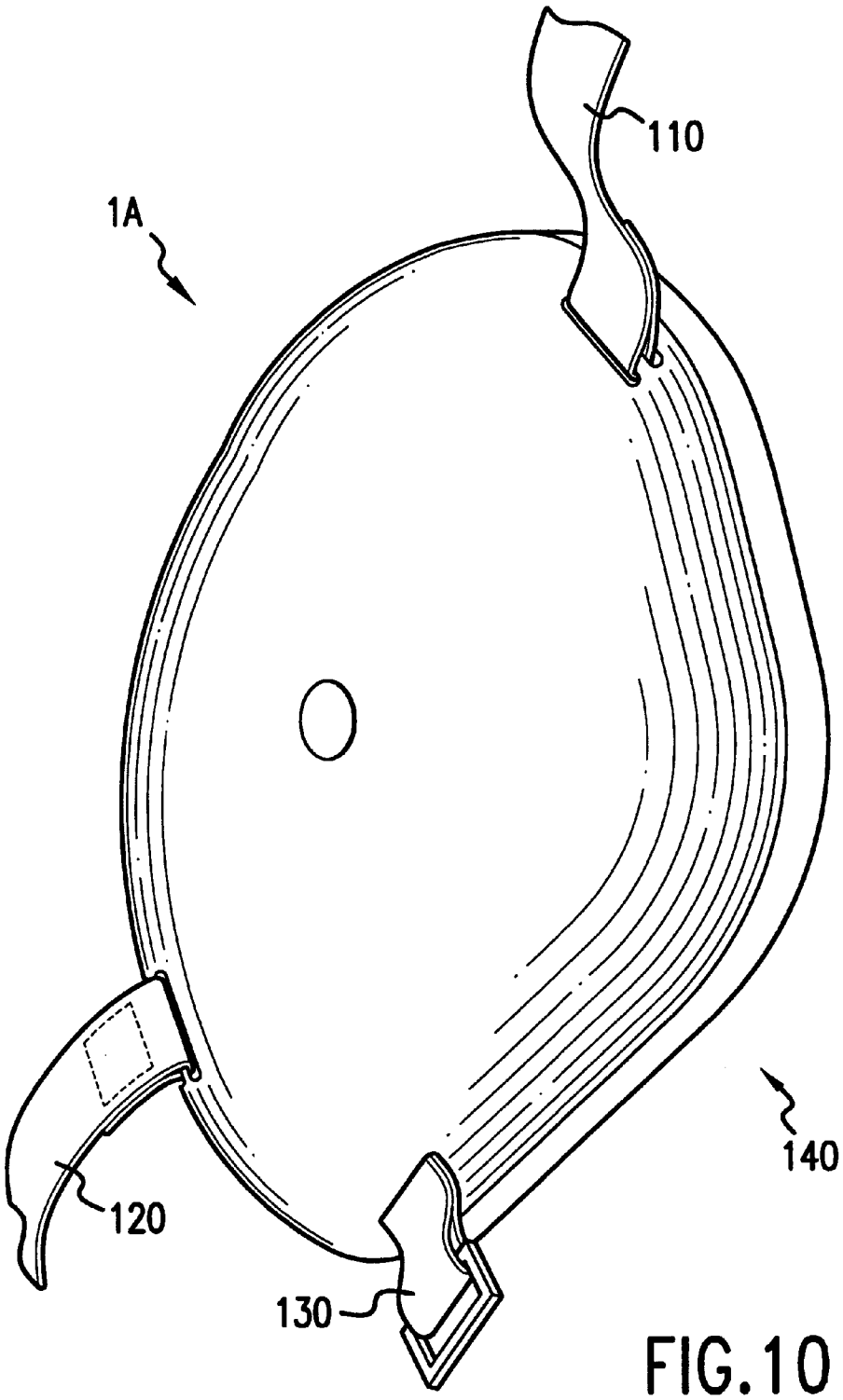
FIG. 10 illustrates an alternative embodiment for an ear protector in accordance with the principles of the present invention.

FIG. 10 illustrates another embodiment of the present invention. As can be seen in FIG. 10, the ear protector 1A includes an anatomical landmark 140, which 10 results in ear protector 1A having a triangular-like shape with rounded edges. The concave shape of the lower portion of the ear protector 1A, from anatomical landmark 140 to chin strap 130, reduces friction along the temporomandibular joint ("TMJ") and at the insertion point of the Masseter muscle, which can cause TMJ syndrome and irritation of the Masseter muscle. The shape of ear protector 1A facilitates greater ease in breathing by allowing a wrestler increased freedom to open his mouth. In addition, the facial area over which the ear protector 1A covers is decreased resulting in a reduction of dermatitis caused by chronic aggravation of the facial pores and hair follicles. In this embodiment, a forehead strap 110, a base head strap 120 and a chin strap 130 are still present to connect a first ear protector 1A to a second ear protector (not shown).

Figure 11:
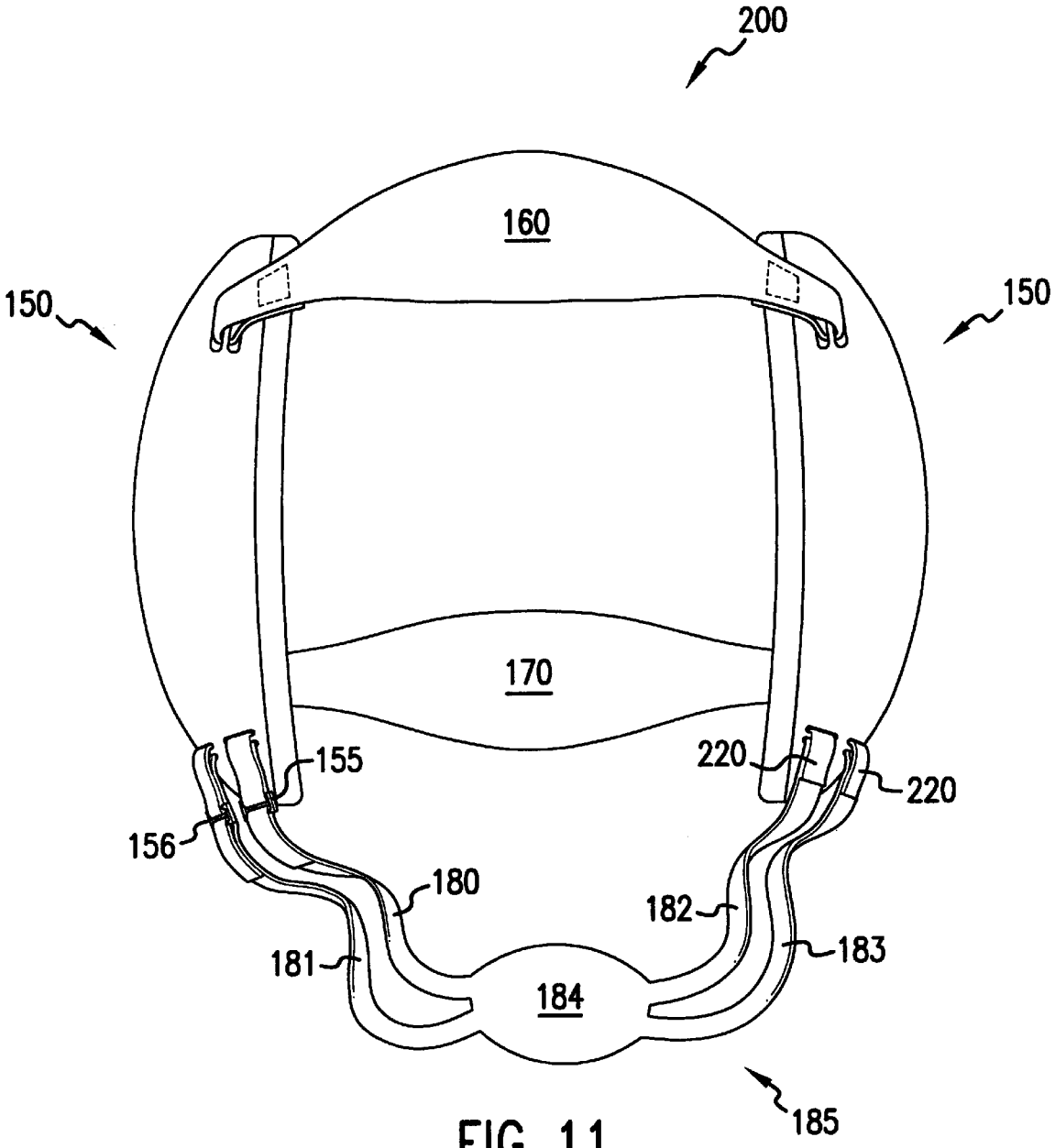
FIG. 11 is a front view of an alternative embodiment for a wrestling headgear in accordance with the principles of the present invention that includes an alternative embodiment for a chin strap.
Figure 12:
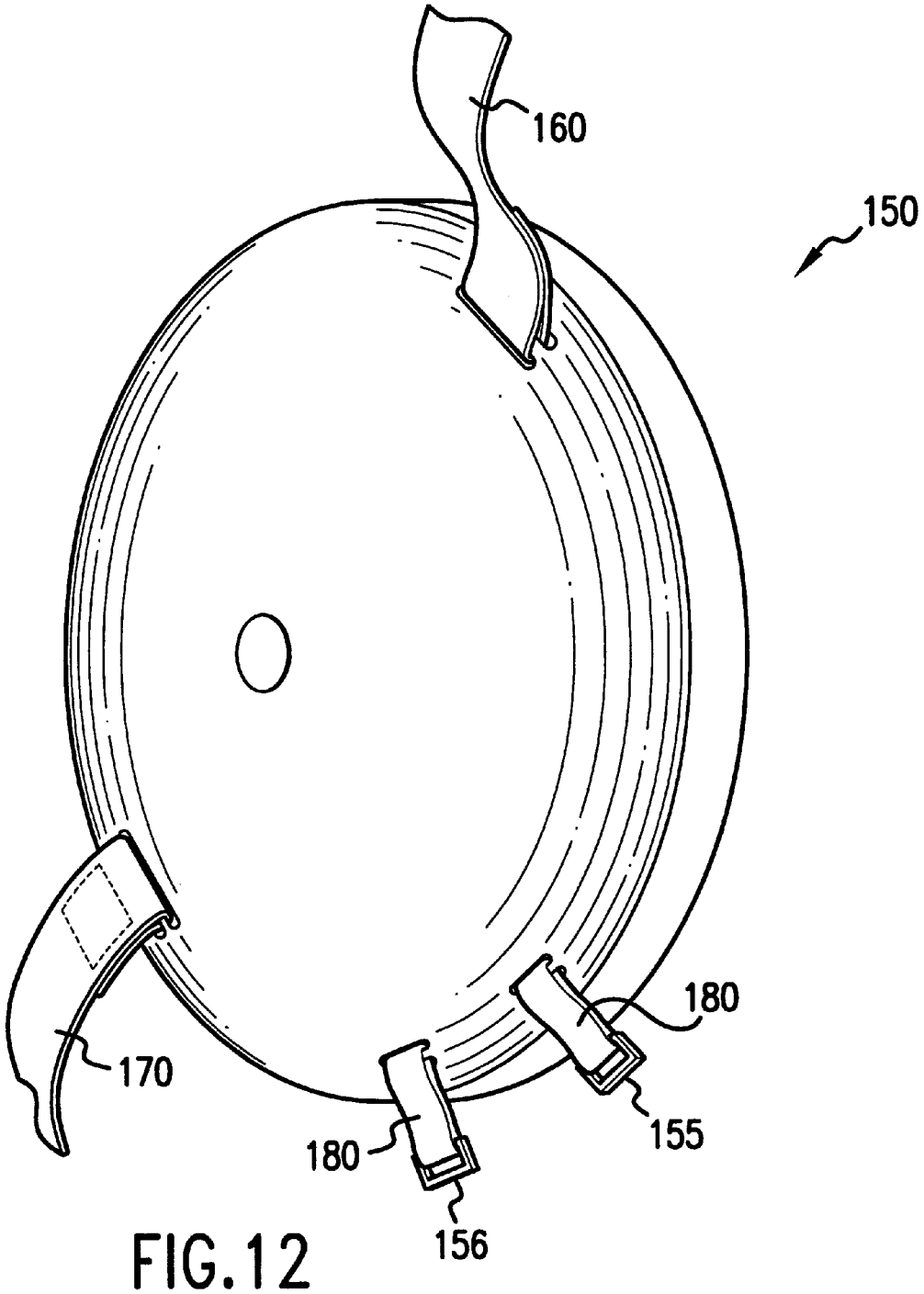
FIG. 12 is a perspective view of an ear protector of the embodiment of FIG. 11.

FIGS. 11 and 12 illustrate another alternative embodiment of the present invention. Wrestling headgear 200 includes two ear protectors 150. The two ear protectors 150 can be connected using a first, or forehead, strap 160, and a second, or base head, strap 170. In addition, the ear protectors 150 can also be connected by third, fourth, fifth, and sixth straps 180–183, respectively, which are also referred to as a four point chin strap 185. The four point chin strap 185 can be made of a flexible semi-expandable material, e.g., spandex or elastic. The third, fourth, fifth, and sixth straps 180–183 connect to a portion of a chin receiver 184, which is also part of the four point chin strap 185. Two of the straps, i.e., straps 182 and 183, in the four point chin strap 185 are connected to one of the ear protectors 150 through holes in the ear protector 150. The straps 182, 183 are threaded through the ear protector 150 and fastened back onto themselves with fasteners 220. The fasteners 220 can be of any type, including hook and loop fasteners. Straps 180, 181 are connected to the other ear protector 150 through loops 155 and 156. The loops 155, 156 are connected to the ear protector 150 by any of a variety of methods and mechanisms, including sewing of the loops to the ear protector. The loops can be comprised of plastic or any other suitable material. Strap 180 is threaded through loop 155 and then fastened back on itself, e.g., with a hook and loop fastener. Strap 181 is fastened in the same manner.

The four point chin strap 185 provides for a more secure fit of the wrestling headgear and for further reducing slippage of the ear protectors by reducing the anterior, posterior, and superior movement of the headgear. Also, the four point chin strap 185 reduces cuts and lacerations by covering the exposed skin of a wrestler to which skin infection could be transmitted from opponents.

The disclosed embodiments are illustrative of the various ways in which the present invention may be practiced. Other embodiments can be implemented by those skilled in the art without departing from the spirit and scope of the present invention.

what is claimed is:

1. A wrestling headgear ear protector, comprising:

an ear protection member; and a variably adjust able support member disposed on an inner portion of the ear protection member.

2. The ear protector of claim 1, wherein the variably adjustable support member includes an expandable bladder.

3. The ear protector of claim 2, wherein the expandable bladder is a pneumatic ring.

4. The ear protector of claim 2, wherein the expandable bladder includes a liquid fill material.

5. The ear protector of claim 1, wherein the variably adjustable support member comprises an air inflatable bladder.

6. The ear protector of claim 1, wherein the variably adjustable support member comprises a water inflatable bladder.

7. The ear protector of claim 1, further comprising a first protective material disposed on an outer portion of the ear protection member.

8. The ear protector of claim 7, further comprising a second protective material wherein the first protective material is disposed between the outer portion of the ear protection member and the second protective material.

9. The ear protector of claim 8, wherein the first protective material is a medium density closed cell foam and the second protective material has a low coefficient of friction.

10. The ear protector of claim 8, further comprising a third material wherein the variably adjustable support member is disposed between the inner portion of the ear protection member and the third material.

11. The ear protector of claim 10, wherein the third material includes a non-slip material.

12. The ear protector of claim 10, wherein the second protective material includes an adjustable portion at an outer edge of the second protective material and wherein the outer edge of the second protective material is joined to the third material, the adjustable portion of the second protective material disposed at an outer edge of the ear protection member.

13. The ear protector of claim 12, wherein the adjustable portion comprises a nylon material.

14. The ear protector of claim 12, wherein the adjustable portion is configured in a first expanded configuration when the variably adjustable support member is configured in a first expanded configuration and wherein the adjustable portion is configured in a second contracted configuration when the variably adjustable support member is configured in a second contracted configuration.

15. The ear protector of claim 1, wherein the ear protection member is comprised of a plastic material.

16. The ear protector of claim 1, wherein the ear protection member is comprised of a leather material.

17. A protective headgear comprising:

a first ear protection member and a second ear protection member;

a first variably adjustable support member disposed on an inner portion of the first ear protection member;

a second variably adjustable support member disposed on an inner portion of the second ear protection member;

a first strap connected at a first end to a first portion of the first ear protection member and at a second end to a first portion of the second ear protection member; and a second strap connected at a first end to a second portion of the first ear protection member and at a second end to a second portion of the second ear protection member.

18. The headgear of claim 17, further comprising a third strap connected at a first end to a third portion of the first ear protection member and at a second end to a third portion of the second ear protection.

19. The headgear of claim 17, wherein each of the first and second straps are connected to the first and second ear protection members at the first and second ends of the first and second straps by a hook and loop fastener.

20. The headgear of claim 17, wherein an underside of each of the first and second straps include a non-slip material.

21. The headgear of claim 20, wherein the non-slip fabric material is chamois.

22. The headgear of claim 17, wherein the first and second straps are comprised of a nylon mesh material.

23. The headgear of claim 18, wherein the third strap is comprised of a nylon mesh material.

24. The headgear of claim 17, wherein the first and second straps have a width greater than 2 inches.

25. A method of defining an ear receiving cavity included in an ear protector of a wrestling headgear, comprising the step of:

configuring a variably adjustable support member, the variably adjustable support member disposed on an inner portion of an ear protection member.

26. The method of claim 25 wherein the step of configuring the variably adjustable support member includes the step of changing a volume of gas disposed in the variably adjustable support member.

27. The method of claim 26 wherein the gas is air.

28. The method of claim 25 wherein the step of configuring the variably adjustable support member includes the step of changing a volume of liquid disposed in the variably adjustable support member.

29. A method of constructing a wrestling headgear protector for protecting an ear comprising the steps of:

defining an ear cavity by configuring a variably adjustable support member, the variably adjustable support member disposed on an inner portion of an ear protection member.

* * * * *